US010781399B2

(12) United States Patent
Backer et al.

(10) Patent No.: US 10,781,399 B2
(45) Date of Patent: Sep. 22, 2020

(54) ADDITIVE FOR CONTROLLING SPOTTING IN AUTOMATIC DISHWASHING SYSTEMS

(71) Applicants: Rohm and Haas Company, Collegeville, PA (US); Dow Global Technologies LLC, Midland, MI (US)

(72) Inventors: Scott Backer, Phoenixville, PA (US); Marianne P. Creamer, Warrington, PA (US); Severine Ferrieux, Valbonne (FR); Paul Mercando, Pennsburg, PA (US); Eric P. Wasserman, Collegeville, PA (US)

(73) Assignees: Dow Global Technologies LLC, Midland, MI (US); Rohm and Haas Company, Collegeville, PA (US)

( * ) Notice: Subject to any disclaimer, the term of this patent is extended or adjusted under 35 U.S.C. 154(b) by 0 days.

(21) Appl. No.: 16/346,136

(22) PCT Filed: Nov. 27, 2017

(86) PCT No.: PCT/US2017/063253
§ 371 (c)(1),
(2) Date: Apr. 30, 2019

(87) PCT Pub. No.: WO2018/111521
PCT Pub. Date: Jun. 21, 2018

(65) Prior Publication Data

US 2019/0292491 A1 Sep. 26, 2019

(30) Foreign Application Priority Data

Dec. 16, 2016 (EP) ..... 16290243

(51) Int. Cl.

| | |
|---|---|
| ***C11D 1/66*** | (2006.01) |
| ***C11D 3/08*** | (2006.01) |
| ***C11D 3/10*** | (2006.01) |
| ***C11D 3/33*** | (2006.01) |
| ***C11D 3/37*** | (2006.01) |
| ***C11D 3/395*** | (2006.01) |
| ***C11D 1/74*** | (2006.01) |
| ***C11D 3/20*** | (2006.01) |

(52) U.S. Cl.
CPC ..... *C11D 1/74* (2013.01); *C11D 1/66* (2013.01); *C11D 3/08* (2013.01); *C11D 3/10* (2013.01); *C11D 3/2086* (2013.01); *C11D 3/33* (2013.01); *C11D 3/3761* (2013.01); *C11D 3/395* (2013.01)

(58) Field of Classification Search
CPC .... C11D 1/66; C11D 3/08; C11D 3/10; C11D 3/2086; C11D 3/33; C11D 3/3757; C11D 3/395
See application file for complete search history.

(56) References Cited

U.S. PATENT DOCUMENTS

| | | | | |
|---|---|---|---|---|
| 4,559,159 | A | 12/1985 | Denzinger et al. | |
| 4,686,062 | A * | 8/1987 | Kermode ..... | C11D 3/2075 510/315 |
| 5,399,639 | A | 3/1995 | Kimpton et al. | |
| 5,431,846 | A | 7/1995 | Christopher et al. | |
| 8,623,151 | B2 | 1/2014 | Olson et al. | |
| 2011/0009303 | A1 | 1/2011 | Tsumori et al. | |
| 2013/0025871 | A1 | 1/2013 | O'Connell et al. | |

FOREIGN PATENT DOCUMENTS

| | | | |
|---|---|---|---|
| DE | 4321430 | A1 | 1/1995 |
| EP | 625567 | A2 | 11/1994 |
| EP | 634428 | A2 | 1/1995 |
| EP | 706557 | A1 | 4/1996 |
| WO | 9417170 | A1 | 8/1994 |
| WO | 2016057602 | A1 | 4/2016 |
| WO | 2016153668 | A1 | 9/2016 |

* cited by examiner

*Primary Examiner* — Brian P Mruk
(74) *Attorney, Agent, or Firm* — Kenneth Crimaldi

(57) ABSTRACT

An automatic dishwashing detergent composition comprising: (a) 0.5 to 8 wt % of a polymer comprising polymerized units of: (i) 5 to 75 wt % itaconic acid, (ii) 10 to 60 wt % of vinyl acetate; and (iii) 10 to 50 wt % (meth)acrylic acid; and having $M_w$ from 5,000 to 100,000; (b) 2 to 50 wt % of an aminocarboxylate builder; (c) 1 to 10 wt % of a nonionic surfactant; (d) 20 to 75 wt % of carbonate, citrate, silicate or a combination thereof; and (e) 5 to 25 wt % of a bleaching agent.

4 Claims, No Drawings

ADDITIVE FOR CONTROLLING SPOTTING IN AUTOMATIC DISHWASHING SYSTEMS

BACKGROUND

This invention relates generally to a detergent composition that reduces scale formation of dishware in automatic dishwashing.

Automatic dishwashing detergents are generally recognized as a class of detergent compositions distinct from those used for fabric washing or water treatment. Automatic dishwashing detergents are required to produce a spotless and film-free appearance on washed items after a complete cleaning cycle. Phosphate-free compositions rely on non-phosphate builders, such as salts of citrate, carbonate, silicate, disilicate, bicarbonate, aminocarboxylates and others to sequester calcium and magnesium from hard water, and upon drying, leave an insoluble visible deposit. Polymers made from itaconic acid and vinyl acetate are known for use in automatic dishwashing systems. For example, U.S. Pat. No. 5,431,846 discloses such a polymer in a detergent composition. However, this reference discloses only block copolymers and does not disclose the compositions of the present invention.

STATEMENT OF INVENTION

The present invention is directed to an automatic dishwashing detergent composition comprising: (a) 0.5 to 8 wt % of a polymer comprising polymerized units of: (i) 5 to 75 wt % itaconic acid, (ii) 10 to 60 wt % of vinyl acetate; and (iii) 10 to 50 wt % (meth)acrylic acid; and having $M_w$ from 5,000 to 100,000; (b) 2 to 50 wt % of an aminocarboxylate builder; (c) 1 to 15 wt % of a nonionic surfactant; (d) 20 to 75 wt % of carbonate, citrate, silicate or a combination thereof; and (e) 5 to 25 wt % of a bleaching agent.

The present invention is further directed to an automatic dishwashing detergent composition comprising: (a) 0.5 to 8 wt % of a polymer comprising polymerized units of: (i) 5 to 95 wt % itaconic acid and (ii) 5 to 95 wt % of vinyl acetate (b) 2 to 50 wt % of an aminocarboxylate builder; (c) 1 to 15 wt % of a nonionic surfactant; (d) 20 to 75 wt % of carbonate, citrate, silicate or a combination thereof; and (e) 5 to 25 wt % of a bleaching agent.

DETAILED DESCRIPTION

All percentages are weight percentages (wt %), and all temperatures are in ° C., unless otherwise indicated. Weight average molecular weights, $M_w$, are measured by gel permeation chromatography (GPC) using polyacrylic acid standards, as is known in the art. The techniques of GPC are discussed in detail in Modern Size Exclusion Chromatography, W. W. Yau, J. J. Kirkland, D. D. Bly; Wiley-Interscience, 1979, and in A Guide to Materials Characterization and Chemical Analysis, J. P. Sibilia; VCH, 1988, p. 81-84. The molecular weights reported herein are in units of daltons. As used herein the term "(meth)acrylic" refers to acrylic or methacrylic; the term "carbonate" to alkali metal or ammonium salts of carbonate, bicarbonate or sesquicarbonate; the term "silicate" to alkali metal or ammonium salts of silicate, disilicate, metasilicate; and the term "citrate" to alkali metal citrates. Preferably, the carbonates, silicates or citrates are sodium, potassium or lithium salts; preferably sodium or potassium; preferably sodium. The terms "percarbonate" and "perborate" refer to alkali metal or ammonium salts of these anions, preferably potassium or sodium, preferably sodium. Weight percentages of carbonates or citrates are based on the actual weights of the salts, including metal ions. The term "phosphate-free" refers to compositions containing less than 0.5 wt % phosphate (as elemental phosphorus), preferably less than 0.2 wt %, preferably less than 0.1 wt %, preferably no detectable phosphate. Weight percentages in the detergent composition are based on the entire composition including any water that may be present. Percentages of monomer units in the polymer are percentages of solids weight, i.e., excluding any water present in a polymer emulsion. All references to polymerized carboxylic acid units in the polymers include metal salts of the acid which would be present at pH values near or above the pKa of the carboxylic acid groups.

Preferably, the amount of carbonate, citrate, silicate or a combination thereof in the detergent composition is at least 10 wt %, preferably at least 20 wt %, preferably at least 25 wt %, preferably at least 30 wt %, preferably at least 33 wt %, preferably at least 36 wt %; preferably no more than 65 wt %, preferably no more than 60 wt %, preferably no more than 55 wt %. Preferably, the amount of carbonate is at least 5 wt %, preferably at least 10 wt %, preferably at least 15 wt %; preferably no more than 45 wt %, preferably no more than 40 wt %, preferably no more than 35 wt %, preferably no more than 30 wt %. Preferably, the amount of citrate is at least 5 wt %, preferably at least 10 wt %, preferably at least 15 wt %; preferably no more than 4 wt %, preferably no more than 35 wt %, preferably no more than 30 wt %, preferably no more than 25 wt %. Preferably, the amount of silicate is no more than 15 wt %, preferably no more than 10 wt %, preferably no more than 6 wt %, preferably no more than 4 wt %.

Preferably, the bleaching agent is percarbonate, perborate, sodium hypochlorite or trichlorocyanuric acid; preferably percarbonate or perborate; preferably percarbonate. Preferably, the amount of bleaching agent is at least 8 wt %, preferably at least 11 wt %, preferably at least 12 wt %; preferably no more than 25 wt %, preferably no more than 22 wt %, preferably no more than 20 wt %, preferably no more than 18 wt %.

Preferably, the aminocarboxylate builder(s) is present in an amount of at least 3 wt %; preferably at least 5 wt %, preferably at least 6 wt %, preferably at least 7 wt %, preferably at least 8 wt %; preferably no more than 40 wt %, preferably no more than 30 wt %, preferably no more than 25 wt %, preferably no more than 20 wt %, preferably no more than 15 wt %. Preferred aminocarboxylate builders include methylglycinediacetic acid (MGDA) and its salts, glutamic acid diacetic acid (GLDA) and its salts, iminodisuccinic acid (IDSA) and its salts and aspartic acid diacetic acid (ASDA) and its salts. MGDA is especially preferred.

Preferably, nonionic surfactants have the formula $RO\text{-}(M)_x\text{-}(N)_y\text{—}OH$ or $R\text{—}O\text{-}(M)_x\text{-}(N)_y\text{—}(P)_z\text{—}OH$ in which M represents polymerized units of ethylene oxide, N represents polymerized units of a $C_3$-$C_{18}$ 1,2-epoxyalkane, P represents a $C_6$-$C_{18}$-alkyl glycidyl ether, x is 5-40, y is 0-20, z is 0-3 and R represents a $C_6$-$C_{22}$ linear or branched alkyl group.

Preferably, nonionic surfactants have the formula $RO\text{-}(M)_x\text{-}(N)_y\text{—}OH$ or $R\text{—}O\text{-}(M)_x\text{-}(N)_y\text{—}O\text{—}R'$ in which M and N are units derived from alkylene oxides (of which one is ethylene oxide), R represents a $C_6$-$C_{22}$ linear or branched alkyl group, and R' represents a group derived from the reaction of an alcohol precursor with a $C_6$-$C_{22}$ linear or branched alkyl halide, epoxyalkane, or glycidyl ether. Preferably, surfactants have the formula $RO\text{-}(M)_x\text{—}OH$, where M represents polymerized ethylene oxide units.

Preferably x is at least three, preferably at least five; preferably no more than ten, preferably no more than eight. Preferably, R and R' have at least eight carbon atoms, preferably at least ten. Preferably, the composition comprises at least 2 wt % of nonionic surfactant(s), preferably at least 3 wt %; preferably no more than 12 wt %, preferably no more than 9 wt %, preferably no more than 8 wt %.

In a preferred embodiment, the composition comprises at least 1 wt % of the polymer comprising itaconic acid, vinyl acetate and acrylic acid, preferably at least 1.5 wt %, preferably at least 2 wt %, preferably at least 2.5 wt %, preferably at least 3 wt %, preferably at least 3.5 wt %; preferably no more than 8 wt %, preferably no more than 7.5 wt %, preferably no more than 7 wt %, preferably no more than 6.5 wt %.

In another preferred embodiment, the composition comprises at least 1 wt % of the polymer comprising itaconic acid and vinyl acetate, preferably at least 1.5 wt %, preferably at least 2 wt %, preferably at least 2.5 wt %, preferably at least 3 wt %, preferably at least 3.5 wt %; preferably no more than 8 wt %, preferably no more than 7.5 wt %, preferably no more than 7 wt %, preferably no more than 6.5 wt %.

Preferably, the polymer comprising itaconic acid, vinyl acetate and (meth)acrylic acid comprises at least 10 wt % polymerized units of itaconic acid, preferably at least 15 wt %, preferably at least 20 wt %, preferably at least 25 wt %; preferably no more than 65 wt %, preferably no more than 55 wt %, preferably no more than 50 wt %, preferably no more than 45 wt %, preferably no more than 40 wt %, preferably no more than 35 wt %. Preferably, the polymerized vinyl acetate units are at least 20 wt % of this polymer, preferably at least 25 wt %, preferably at least 30 wt %, preferably at least 35 wt %; preferably no more than 55%, preferably no more than 50 wt %, preferably no more than 45 wt %. Preferably, the polymerized (meth)acrylic acid units are at least 15 wt % of this polymer, preferably at least 20 wt %, preferably at least 25 wt %; preferably no more than 65 wt %, preferably no more than 55 wt %, preferably no more than 50 wt %, preferably no more than 45 wt %, preferably no more than 40 wt %, preferably no more than 35 wt %. Preferably, the (meth)acrylic acid is acrylic acid.

Preferably, the polymer comprising itaconic acid and vinyl acetate comprises at least 10 wt % polymerized units of itaconic acid, preferably at least 15 wt %, preferably at least 20 wt %, preferably at least 25 wt %, preferably at least 30 wt %, preferably at least 35 wt %, preferably at least 39 wt %, preferably at least 42 wt %; preferably no more than 70 wt %, preferably no more than 65 wt %, preferably no more than 61 wt %, preferably no more than 58 wt %, preferably no more than 55 wt %, preferably no more than 53 wt %, preferably no more than 51 wt %, preferably no more than 50 wt %. Preferably, the polymerized vinyl acetate units are at least 30 wt % of this polymer, preferably at least 35 wt %, preferably at least 39 wt %, preferably at least 42 wt %, preferably at least 45 wt %, preferably at least 47 wt %, preferably at least 49 wt %; preferably no more than 90 wt %, preferably no more than 85 wt %, preferably no more than 80 wt %, preferably no more than 75 wt %, preferably no more than 70 wt %, preferably no more than 65 wt %, preferably no more than 61 wt %, preferably no more than 58 wt %.

Preferably, a polymer of this invention comprises no more than 0.3 wt % polymerized units of crosslinking monomers, preferably no more than 0.1 wt %, preferably no more than 0.05 wt %, preferably no more than 0.03 wt %, preferably no more than 0.01 wt %. A crosslinking monomer is a multiethylenically unsaturated monomer.

Preferably, the amount of polymerized AMPS units (including metal or ammonium salts) in a polymer of this invention is no more than 10 wt %, preferably no more than 5 wt %, preferably no more than 2 wt %, preferably no more than 1 wt %. Preferably, a polymer of this invention contains no more than 8 wt % polymerized units of esters of acrylic or methacrylic acid, preferably no more than 5 wt %, preferably no more than 3 wt %, preferably no more than 1 wt %.

Preferably, the polymer has $M_w$ of at least 7,000, preferably at least 9,000, preferably at least 10,000, preferably at least 11,000, preferably at least 12,000; preferably no more than 70,000, preferably no more than 50,000, preferably no more than 30,000, preferably no more than 25,000.

The polymer may be used in combination with other polymers useful for controlling insoluble deposits in automatic dishwashers, including, e.g, polymers comprising combinations of residues of acrylic acid, methacrylic acid, maleic acid or other diacid monomers, esters of acrylic or methacrylic acid including polyethylene glycol esters, styrene monomers, AMPS and other sulfonated monomers, and substituted acrylamides or methacrylamides. Particularly useful polymers are those which are capable of improving spotting, e.g., RO-$(M)_x$-$(N)_y$—OH or R—O-$(M)_x$-$(N)_y$—$(P)_z$—OH, for which the parameters are defined herein.

Preferably, the polymer of this invention is produced by solution polymerization. Preferably, the polymer is a random copolymer. Preferred solvents include 2-propanol, ethanol, water, and mixtures thereof. Preferably, the initiator does not contain phosphorus. Preferably, the polymer contains less than 1 wt % phosphorus, preferably less than 0.5 wt %, preferably less than 0.1 wt %, preferably the polymer contains no phosphorus. Preferably, polymerization is initiated with persulfate and the end group on the polymer is a sulfate or sulfonate. The polymer may be in the form of a water-soluble solution polymer, slurry, dried powder, or granules or other solid forms.

Other components of the automatic dishwashing detergent composition may include, e.g., surfactants, oxygen and/or chlorine bleaches, bleach activators, enzymes, foam suppressants, colors, fragrances, antibacterial agents and fillers. Fillers in tablets or powders are inert, water-soluble substances, typically sodium or potassium salts, e.g., sodium or potassium sulfate and/or chloride, and typically are present in amounts ranging from 0 wt % to 70 wt %; preferably no more than 50 wt %, preferably no more than 40 wt %, preferably no more than 30 wt %, preferably no more than 20 wt %, preferably no more than 15 wt %; preferably at least 2 wt %, preferably at least 4 wt %. Fillers in gel formulations may include those mentioned above and also water. Fragrances, dyes, foam suppressants, enzymes and antibacterial agents usually total no more than 5 wt % of the composition.

Preferably, the composition has a pH (at 1 wt % in water) of at least 10, preferably at least 11.5; in some embodiments the pH is no greater than 13.

The composition can be formulated in any typical form, e.g., as a tablet, powder, monodose, sachet, paste, liquid or gel. The composition can be used under typical operating conditions for any typical automatic dishwasher. Typical water temperatures during the washing process preferably are from 20° C. to 85° C., preferably from 30° C. to 70° C. Typical concentrations for the composition as a percentage of total liquid in the dishwasher preferably are from 0.1 to 1 wt %, preferably from 0.2 to 0.7 wt %. With selection of an appropriate product form and addition time, the composition may be present in the prewash, main wash, penultimate rinse, final rinse, or any combination of these cycles.

EXAMPLES

Synthesis

Example A. Itaconic Acid-Vinyl Acetate Copolymer

To a round-bottom glass flask equipped with overhead stirrer, nitrogen bubbler, reflux condenser, and thermocouple were added 2-propanol (250 g), itaconic acid (97.5 g), and t-butyl peroxy 2-ethylhexanoate (5 g) and the contents were heated to 80° C. and held there for 1 h. Temperature was maintained through a controller tied to a jack that raised and lowered a heating mantle and removed heat by blowing air directly onto the flask. To the homogeneous solution were added via syringe pump vinyl acetate (107.5 g) over a period of 125 min and a solution of t-butyl peroxy 2-ethylhexanoate (10 g) in 2-propanol (60 g) over 155 min. During the period of monomer addition reflux was observed and the temperature dropped to 75-78° C. After initiator addition ceased the solution was heated with a set point of 80° C. for another 2 h. The solution was allowed to cool and left to stand overnight.

The next day a portion of the solution (182.8 g) was removed and the remainder was subjected to solvent exchange and neutralization. A Dean-Stark trap was fitted to the kettle and heat was applied to maintain distillation of mixed solvent, residual monomer, and water, which was now added. Distillation continued with rising pot temperature until the thermocouple registered 100° C. and the rate of distillation slowed. A total of 280 g water were added while 346 g distillate were removed. The solution was allowed to cool, and then 56.5 sodium hydroxide (50% solution) was added to neutralize the mixture; final pH=6.8. Polymer before solvent exchange: 26.93 wt % solids; $M_w$=655880, $M_n$=2146. Polymer after solvent exchange: 34.18 wt % solids; $M_w$=6391, $M_n$=1875.

Example B. Acrylic Acid-Vinyl Acetate Copolymer

To a round-bottom glass flask equipped with overhead stirrer, nitrogen bubbler, reflux condenser, and thermocouple were added 2-propanol (250 g) and t-butyl peroxy 2-ethylhexanoate (5 g) and the contents were heated to 80° C. and held there for 1 h. To the homogeneous solution were added via syringe pump a mixture of vinyl acetate (129 g) and acrylic acid (108 g) over a period of 180 min and a solution of t-butyl peroxy 2-ethylhexanoate (10 g) in 2-propanol (60 g) over 210 min. During the period of monomer addition reflux was observed and the temperature dropped to 75-79° C. After initiator addition ceased the solution was heated with a set point of 80° C. for another 2 h. The solution was allowed to cool and left to stand overnight.

The next day a portion of the solution (182.8 g) was removed and the remainder was subjected to solvent exchange and neutralization. A Dean-Stark trap was fitted to the kettle and heat was applied to maintain distillation of mixed solvent, residual monomer, and water, which was now added. Distillation continued with rising pot temperature until the thermocouple registered 100° C. and the rate of distillation slowed. A total of 280 g water were added while 347 g distillate were removed. The solution was allowed to cool, and then 89.7 sodium hydroxide (50% solution) was added to neutralize the mixture. Polymer before solvent exchange: 45.03 wt % solids; $M_w$=1669800, $M_n$=2013. Polymer after solvent exchange: 54.33 wt % solids; $M_w$=4548, $M_n$=1594.

Example C. Itaconic Acid-Vinyl Acetate Copolymer (2)

To a round-bottom glass flask equipped with overhead stirrer, nitrogen bubbler, reflux condenser, and thermocouple were added 2-propanol (250 g), itaconic acid (130 g), and t-butyl peroxy 2-ethylhexanoate (5 g) and the contents were heated to 80° C. and held there for 1 h. To the homogeneous solution were added via syringe pump vinyl acetate (86 g) over a period of 125 min and a solution of t-butyl peroxy 2-ethylhexanoate (10 g) in 2-propanol (60 g) over 155 min. During the period of monomer addition reflux was observed and the temperature dropped to 75-78° C. After initiator addition ceased the solution was heated with a set point of 80° C. for another 2 h. The solution was allowed to cool and left to stand overnight.

The next day a portion of the solution (184.2 g) was removed and the remainder was subjected to solvent exchange and neutralization. A Dean-Stark trap was fitted to the kettle and heat was applied to maintain distillation of mixed solvent, residual monomer, and water, which was now added. Distillation continued with rising pot temperature until the thermocouple registered 100° C. and the rate of distillation slowed. A total of 240 g water were added while 292 g distillate were removed. The solution was allowed to cool, and then sodium hydroxide (50% solution) was added to neutralize the mixture; final pH=6.8. Polymer before solvent exchange: 32.09 wt % solids; $M_w$=7450, $M_n$=1927. Polymer after solvent exchange: 34.83 wt % solids; $M_w$=6097, $M_n$=1597.

Example D. Acrylic Acid-Itaconic Acid-Vinyl Acetate Terpolymer

To a round-bottom glass flask equipped with overhead stirrer, nitrogen bubbler, reflux condenser, and thermocouple were added 2-propanol (250 g), itaconic acid (65 g), and t-butyl peroxy 2-ethylhexanoate (5 g) and the contents were heated to 80° C. and held there for 1 h. To the homogeneous solution were added via syringe pump a mixture of vinyl acetate (86 g) and acrylic acid (65 g) over a period of 120 min and a solution of t-butyl peroxy 2-ethylhexanoate (10 g) in 2-propanol (60 g) over 150 min. During the period of monomer addition reflux was observed and the temperature dropped to 75-78° C. After initiator addition ceased the solution was heated with a set point of 80° C. for another 2 h. The solution was allowed to cool and left to stand overnight.

The next day a portion of the solution (184.5 g) was removed and the remainder was subjected to solvent exchange and neutralization. A Dean-Stark trap was fitted to the kettle and heat was applied to maintain distillation of mixed solvent, residual monomer, and water, which was now added. Distillation continued with rising pot temperature until the thermocouple registered 100° C. and the rate of distillation slowed. A total of 200 g water were added while 502.1 g distillate were removed. The solution was allowed to cool, and then 67.4 g sodium hydroxide (50% solution) was added to neutralize the mixture to a final pH of 6.2. Polymer before solvent exchange: 41.3 wt % solids; $M_w$=15125, $M_n$=2928. Polymer after solvent exchange: 49.0 wt % solids; $M_w$=14949, $M_n$=2770.

Note: the polymers used in ADW testing had all been solvent-exchanged into water.

Automatic Dishwashing

Food Soil A.

| Ingredients | Weight, g (actual weight to cover transfer loss) |
|---|---|
| Water | 2450.0 |
| Instant Gravy | 87.5 (88.6) |
| Starch | 17.5 |
| Benzoic Acid | 3.5 |
| Margarine | 350.0 |
| Milk (3.5% fat semi skim) | 175.0 |
| Ketchup | 87.5 (90.3) |
| Mustard | 87.5 (90.3) |
| Egg yolk | 10.5 (10.6) |
| Total: | 3269.0 |

Preparation of Food Soil A.

Preparation:

1. Bring water to boil.
2. Mix in 16 oz (474 mL) paper cup the instant gravy, benzoic acid and starch; add this mixture to the boiling water.
3. Add milk and margarine.
4. Let the mixture cool down to approximately 40° C.
5. Add the mixture to a mixer (Polytron).
6. In another 16 oz paper cup, mix the egg yolk, ketchup and mustard using a spoon.
7. Add the cooled mixture to the bowl while stirring continuously.
8. Let the mixture stir for 5 min.
9. Freeze the mixture.

Composition of Food Soil B.

Non-fat dried milk powder (8 g), margarine (32 g), egg yolk (1 g).

US ADW Test in Absence of Food Soil.

Conditions:

Kenmore washers with plastic doors, 20 g base per machine per cycle, normal wash cycle (High Temp. & heated Dry settings), 130° F. (54° C.), 300 ppm WH (2/1 Ca/Mg), 10 cycles, 4 Libbey Collins Glasses, pulled glasses at 1, 3, 5 and 10 cycles, respectively. ASTM Rating System (1-5); Clear, stripped glass=1.

US ADW Test with Food Soil A.

Conditions:

Kenmore SS-ADW, Model 15693.

Normal wash cycle (~2 h) with heated wash, fuzzy logic engaged, and heated dry.

Water hardness=300 ppm (confirmed by EDTA Titration); Ca/Mg=2/1.

Temporary hardness=tap water, no additional Na-bicarbonate, pH=7.2.

Water temperature in tank 130° F. (54° C.).

Food soil (50 g) charged when the detergent is charged to the wash liquor (20 min into the 120 min run).

US ADW Test with Food Soil B.

Conditions:

Kenmore SS-ADW, Model 15693.

Normal wash cycle (~2 h) with heated wash, fuzzy logic engaged, and heated dry.

Water hardness=300 ppm (confirmed by EDTA Titration); Ca/Mg=2/1.

Temporary hardness=tap water, no additional Na-bicarbonate, pH=7.2.

Water temperature in tank 130° F. (~54° C.).

Food soil (40 g) charged prior to the first of two pre-wash steps.

European ADW Test with High-Egg-Yolk Food Soil.

Conditions:

Machines: Miele G1222 SCL.

Wash at 65° C. (prewash, detergent and soil added at the beginning of the main wash).

Water hardness: 37° fH; Ca/Mg=3/1.

Temporary hardness: 25° fH.

50 g frozen ballast soil (modified STIWA, 50 g).

Ballast load (porcelain, glass, cutlery).

TABLE 1

US ADW Results (no food soil).

| | Ex. E | Ex. F | Ex. G | Ex. H | Ex. I | Ex. J |
|---|---|---|---|---|---|---|
| Ingredients | | | | | | |
| MGDA[1] | 5% | 5% | 5% | 5% | 5% | 5% |
| Sod. Citrate | 10% | 10% | 10% | 10% | 10% | 10% |
| Sod. Carbonate | 25% | 25% | 25% | 25% | 25% | 25% |
| Percarbonate | 15% | 15% | 15% | 15% | 15% | 15% |
| TAED[8] | 4% | 4% | 4% | 4% | 4% | 4% |
| TRITON ™ DF-16 | 1.5% | 1.5% | 1.5% | 1.5% | 1.5% | 1.5% |
| TERGITOL ™ L-61 | 0.5% | 0.5% | 0.5% | 0.5% | 0.5% | 0.5% |
| Poly(acrylic acid)[2] | 4% | 0% | 0% | 0% | 0% | 0% |
| Carboxymethyl inulin[3] | 0% | 4% | 0% | 0% | 0% | 0% |
| IA/VAc copolymer[4] | 0% | 0% | 4% | 0% | 0% | 0% |
| Hybrid acrylate polymer[5] | 0% | 0% | 0% | 4% | 0% | 0% |
| AA/VAc copolymer[6] | 0% | 0% | 0% | 0% | 4% | 0% |
| Poly(itaconic acid)[7] | 0% | 0% | 0% | 0% | 0% | 4% |
| Sod. Sulfate | 35% | 35% | 35% | 35% | 35% | 35% |
| Total Wt % | 100% | 100% | 100% | 100% | 100% | 100% |

TABLE 1-continued

| US ADW Results (no food soil). | | | | | | |
|---|---|---|---|---|---|---|
| | Ex. E | Ex. F | Ex. G | Ex. H | Ex. I | Ex. J |
| Glass Tumblers | | | | | | |
| Filming 10 Cycles, Avg | 3.8 | 3.0 | 2.6 | 3.1 | 3.2 | 4.9 |

[1]TRILON M, BASF
[2]ACUSOL ™ 445N, The Dow Chemical Company
[3]Carboxyline 25-110D, Royal Cosun
[4]Polymer from Example A
[5]Alcogard H5941, AkzoNobel
[6]Polymer from Example B
[7]DSP 5K, Itaconix
[8]Tetraacetyl ethylenediamine

TABLE 2

| US ADW Test with Food Soil A. | | | | | | |
|---|---|---|---|---|---|---|
| | Ex. K | Ex. L | Ex. M | Ex. N | Ex. O | Ex. P |
| Ingredients | | | | | | |
| MGDA[1] | 5% | 5% | 5% | 5% | 5% | 5% |
| Sod. Citrate | 10% | 10% | 10% | 10% | 10% | 10% |
| Sod. Carbonate | 25% | 25% | 25% | 25% | 25% | 25% |
| Percarbonate | 15% | 15% | 15% | 15% | 15% | 15% |
| TAED | 4% | 4% | 4% | 4% | 4% | 4% |
| TRITON ™ DF-16 | 1.5% | 1.5% | 1.5% | 1.5% | 1.5% | 1.5% |
| TERGITOL ™ L-61 | 0.5% | 0.5% | 0.5% | 0.5% | 0.5% | 0.5% |
| α-Amylase from *Bacillus* | 1% | 1% | 1% | 1% | 1% | 1% |
| Protease from *Bacillus* | 2% | 2% | 2% | 2% | 2% | 2% |
| Sodium disilicate[2] | 1% | 1% | 1% | 1% | 1% | 1% |
| Poly(acrylic acid)[3] | 4% | 0% | 0% | 0% | 0% | 0% |
| Carboxymethyl inulin[4] | 0% | 0% | 4% | 0% | 0% | 0% |
| IA/VAc copolymer[5] | 0% | 4% | 0% | 0% | 0% | 0% |
| Hybrid acrylate polymer[6] | 0% | 0% | 0% | 4% | 0% | 0% |
| AA/VAc copolymer[7] | 0% | 0% | 0% | 0% | 0% | 4% |
| Poly(itaconic acid)[8] | 0% | 0% | 0% | 0% | 4% | 0% |
| Sod. Sulfate | 31% | 31% | 31% | 31% | 31% | 31% |
| Total Wt % | 100% | 100% | 100% | 100% | 100% | 100% |
| Glass Tumblers | | | | | | |
| Filming 15 Cycles, Avg | 2.3 | 1.5 | 2.8 | 2.4 | 3.6 | 2.1 |
| Spotting 15 Cycles, Avg | 2.7 | 4.2 | 1.6 | 2.8 | 4.0 | 3.0 |

[1]TRILON M, BASF
[2]Britesil H 20
[3]ACUSOL ™ 445N, The Dow Chemical Company
[4]Carboxyline 25-110D, Royal Cosun
[5]Polymer from Example A
[6]Alcogard H5941
[7]Polymer from Example B
[8]DSP 5K, Itaconix

TABLE 3

| US ADW Test with Food Soil B. | | | | | |
|---|---|---|---|---|---|
| | Ex. Q | Ex. R | Ex. S | Ex. T | Ex. U |
| Ingredients | | | | | |
| MGDA[1] | 5% | 5% | 5% | 5% | 5% |
| Sod. Citrate | 10% | 10% | 10% | 10% | 10% |
| Sod. Carbonate | 25% | 25% | 25% | 25% | 25% |
| Percarbonate | 15% | 15% | 15% | 15% | 15% |
| TAED | 4% | 4% | 4% | 4% | 4% |
| DOWFAX ™ 20B102 | 0.5% | 0.5% | 0.5% | 0.5% | 0.5% |

TABLE 3-continued

| US ADW Test with Food Soil B. | | | | | |
|---|---|---|---|---|---|
| | Ex. Q | Ex. R | Ex. S | Ex. T | Ex. U |
| TRITON ™ CG-650 | 3.5% | 3.5% | 3.5% | 3.5% | 3.5% |
| α-Amylase from *Bacillus* | 1% | 1% | 1% | 1% | 1% |
| Protease from *Bacillus* | 2% | 2% | 2% | 2% | 2% |
| Sodium disilicate[2] | 1% | 1% | 1% | 1% | 1% |
| Poly(acrylic acid)[3] | 4% | 0% | 0% | 0% | 0% |
| IA/VAc copolymer[4] | 0% | 4% | 0% | 0% | 0% |
| AA/VAc copolymer[5] | 0% | 0% | 4% | 0% | 0% |

TABLE 3-continued

| US ADW Test with Food Soil B. | | | | | |
|---|---|---|---|---|---|
| | Ex. Q | Ex. R | Ex. S | Ex. T | Ex. U |
| IA/VAc copolymer (2)[6] | 0% | 0% | 0% | 4% | 0% |
| AA/IA/VAc terpolymer[7] | 0% | 0% | 0% | 0% | 4% |
| Sod. Sulfate | 29% | 29% | 29% | 29% | 29% |
| Total Wt % | 100% | 100% | 100% | 100% | 100% |
| Glass Tumblers | | | | | |
| Filming 15 Cycles, Avg | 2.7 | 1.4 | 1.8 | 1.9 | 1.6 |
| Spotting 15 Cycles, Avg | 2.5 | 2.7 | 2.7 | 2.5 | 3.6 |

[1]TRILON M, BASF
[2]Britesil H 20
[3]ACUSOL ™ 445N, The Dow Chemical Company
[4]Polymer from Example A
[5]Polymer from Example B
[6]Polymer from Example C
[7]Polymer from Example D

The invention claimed is:

1. An automatic dishwashing detergent composition for reducing scale formation of dishware in automatic dishwashing comprising: (a) 0.5 to 8 wt % of a polymer comprising polymerized units of: (i) 20 to 65 wt % itaconic acid, (ii) 20 to 55 wt % of vinyl acetate; and (iii) 15 to 65 wt % of (meth)acrylic acid; and having $M_w$ from 5,000 to 100,000; (b) 2 to 50 wt % of an aminocarboxylate builder selected from the group consisting of methylglycinediacetic acid and its salts, glutamic acid diacetic acid and its salts, iminodisuccinic acid and its salts, aspartic acid diacetic acid and its salts, and mixtures thereof; (c) 1 to 15 wt % of a nonionic surfactant; (d) 20 to 75 wt % of an alkali metal or ammonium salts of carbonate, bicarbonate or sesquicarbonate; alkali metal citrates; alkali metal or ammonium salts of silicate, disilicate or metasilicate; or a combination thereof; and (e) 5 to 25 wt % of a bleaching agent.

2. The composition of claim 1 in which the polymer comprises polymerized units of: (i) 20 to 45 wt % itaconic acid, (ii) 20 to 50 wt % of vinyl acetate; and (iii) 15 to 45 wt % acrylic acid.

3. The composition of claim 2 in which the automatic dishwashing detergent comprises: (a) 2 to 8 wt % of the polymer; (b) 5 to 30 wt % of an aminocarboxylate builder; (c) 2 to 12 wt % of a nonionic surfactant; (d) 33 to 65 wt % of carbonate, citrate, silicate or a combination thereof; and (e) 8 to 25 wt % of a bleaching agent.

4. The composition of claim 3 in which the polymer has $M_w$ from 7,000 to 70,000.

* * * * *